United States Patent [19]

Herring et al.

[11] Patent Number: 4,756,253

[45] Date of Patent: Jul. 12, 1988

[54] APPARATUS FOR DEPLOYING A FLEXIBLE SAMARA BLADE

[75] Inventors: Dana C. Herring, Derry, N.H.; Elbert W. Duvall, Peabody, Mass.

[73] Assignee: AVCO Corporation, Providence, R.I.

[21] Appl. No.: 895,244

[22] Filed: Aug. 11, 1986

[51] Int. Cl.[4] ..... F42B 25/24; F42B 25/16

[52] U.S. Cl. ..... 102/388; 102/393; 244/3.21

[58] Field of Search ..... 102/388, 382, 384, 393, 102/489; 244/3.21

[56] References Cited

U.S. PATENT DOCUMENTS

| | | | |
|---|---|---|---|
| 3,273,834 | 9/1966 | Bower | 102/388 X |
| 4,356,770 | 11/1982 | Atanasoff et al. | 102/384 |
| 4,492,166 | 1/1985 | Purcell | 102/384 |
| 4,583,703 | 4/1986 | Kline | 102/388 |
| 4,635,553 | 1/1987 | Kane | 102/384 |

*Primary Examiner*—David H. Brown

*Attorney, Agent, or Firm*—Abraham Ogman

[57] ABSTRACT

Apparatus is disclosed which provides for the controlled deployment of a flexible samara blade used to orient and decelerate a submunition cannister which is dispensed at altitude and allowed to free fall to earth. Spin pins are anchored in and extend outwardly from the downstream end of the cannister. Placement of the pins is such that the flexible samara blade can be wrapped around the pins to place the blade in a stowed condition within the periphery of the cannister end prior to launch of the submunition. Caps on the pins are used to inhibit the stowed blade from slipping off the pins. The blade is wrapped around the pins in a direction opposite to the direction of rotation of the submunition during launch. Launching the submunition in a spinning state creates a centrifugal force in the weighted tip of the samara blade causing the wing to unwrap from the stowed to the deployed state. The pins keep tension in the unfolding wing and preclude erroneous twist-up of the flexible blade.

5 Claims, 2 Drawing Sheets

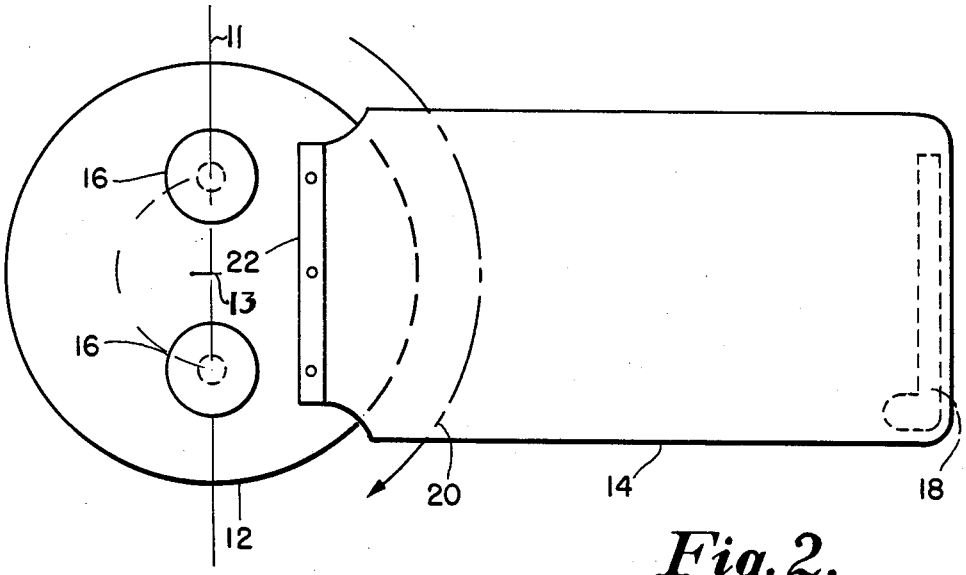
Fig. 2.
Fig. 4A.
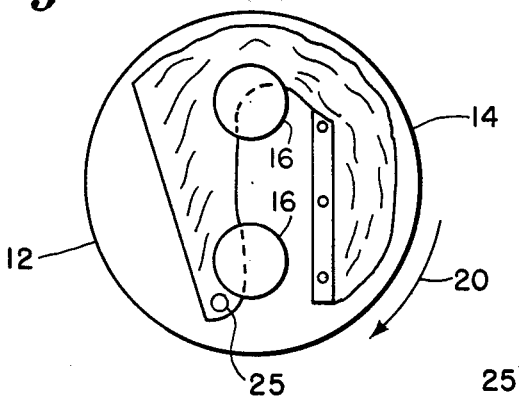
Fig. 4C.
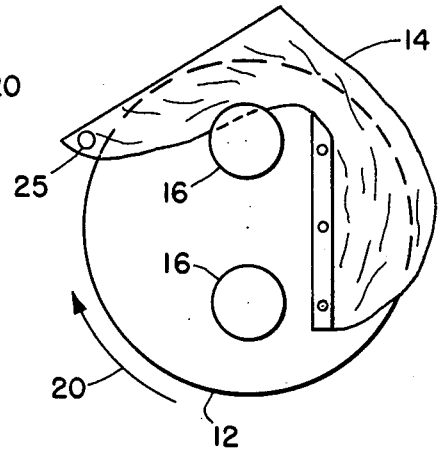
Fig. 4B
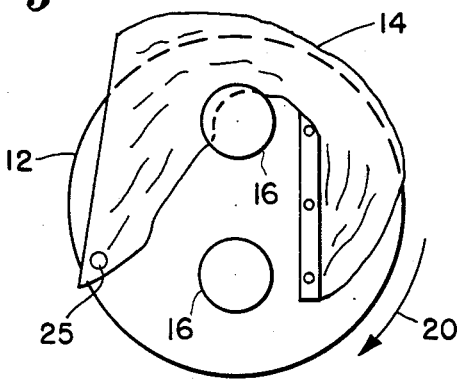

APPARATUS FOR DEPLOYING A FLEXIBLE SAMARA BLADE

BACKGROUND OF THE INVENTION

Apparatus is disclosed which provides fast deployment of a wing which maneuvers a submunition toward a target.

U.S. patent application Ser. No. 787,452, now U.S. Pat. No. 4,635,553 to Kane and assigned to the same assignee as this invention teaches that a samara blade type wing can be used for steering an air launched submunition toward a target. It is to be understood that the submunition is part of a multi-warhead shell which separates into several explosive devices on arrival over a designated target area. Each submunition is capable of destroying a ground target. Available miniaturized electronic circuitry enables each submunition to carry sensors and data processors that make it possible to recognize and seek out a target within a specified field of view.

By adding a samara blade to the rear of the cannister housing the explosive charge, it is possible to induce the submunition to rotatively spin about its central axis as it descends downward much like a maple seed falls from a tree in the springtime. This flexible blade has a tip weight attached which causes the blade to be pulled taut due to the centrifugal forces of the spinning submunition. This causes the blade to behave similar to a rigid blade. With blade twist induced by a properly designed wing tip, the blade pulls the submunition around at a constant spin rate in steady state. The device performs in a manner similar to many rigid winged fruits and seeds, hence the descriptor "Samara" meaning winged fruit.

These samara blades can be used on any submunition which is dispensed at altitude and allowed to free fall to earth. These submunitions may be mines or any of a variety of top attack smart submunitions. Some of these submunitions may be fired out of a cannon and have a resultant high spin rate, in which case the flexible samara blade deployment loads can be very high.

When stowed in the dispenser and to minimize volume, the flexible samara blade needs to be folded in some manner and stored tightly against the end face of the submunition. Upon being dispensed the blade must deploy in a controlled manner to prevent blade twist up, to minimize loads and to transition to stable autorotational motion.

Our invention assures the quick and positive deployment of the samara blade from a stowed status to an active status immediately after the submunition cannister separates in a spinning state from the mother shell casing. Separation usually occurs at an altitude of approximately 1500 ft. above ground.

SUMMARY OF THE INVENTION

This invention forms a part of an air dispensed top attack submunition having the capability to perform a lateral maneuver to increase the size of its effective search footprint for finding and destroying targets. Maneuvering is accomplished by attaching a samara blade to the rear of the cannister-shaped submunition. The samara blade acts as a wing that extends outward from only one side of the submunition. By giving the wing a negative angle of attack with respect to the horizontal plane, an autogyro effect will be produced causing the submunition cannister to continue to spin as it descends at a constant rate toward the ground.

The wing is made of a woven cloth-like material that allows it to be folded out of the way at the rear of the cannister prior to launch. The wing is weighted at the tip so that centrifugal force causes rapid deployment when the wing is released in a spinning state at launch.

Our invention allows wing deployment to occur in a controlled manner, thus minimizing risks of blade twist up during deployment. There is a smooth transition from the stowed to the deployed state. Spin pins are utilized to position the wing in a properly oriented stowed condition. The spin pins are positioned on the top of the submunition and the flexible samara blade is wrapped around them. Caps on the pins are used to inhibit the blade from slipping off the pins. The blade is wrapped around the pins opposite to the direction of rotation. As the weighted blade tip travels outward due to centrifugal force imposed by the spinning submunition, the blade unwraps from the pins keeping tension in the blade fabric at all times. This keeps the blade rotating with the submunition.

The number and location of the spin pins can be tailored to provide specific deployment properties. The pins could be increased in number to provide a smoother acceleration to the wing. Taking this to the limit, the pins become a continuous curved surface, again with or without a cap to prevent the wing from slipping off. The shape of this surface, or the surface approximated by a finite number of pins, can be tailored to provide a controlled acceleration of the wing to either reduce the acceleration loads or to prevent the wing from overspeeding and passing the desired steady state condition. For most implementations, we discovered that two pins judiciously placed in the top face of the cannister accomplish the task while preventing wing twist-up and at the same time minimizing loads imposed on the wing.

Pin placement depends on the span and chord dimensions of the wing as well as the size and shape of the wing tip weight. In the two pin implementation the pins were placed along that diameter 11 of the cannister which was parallel to the chord of the wing. The pins are simply placed into the end of the cannister body next to the wing mount and the wing is wrapped around them opposite the direction of rotation.

In some implementations where a smoother acceleration of the wing is specified, a continuous curved surface is useful against which to stow the wing. This surface may be with or without a cap to prevent the wing from slipping off. The shape of this surface, or the surface approximated by an infinite number of pins, can be tailored to provide a controlled acceleration of the wing to either reduce the acceleration loads or to prevent the wing from overspeeding and passing the desired steady state condition.

BRIEF DESCRIPTION OF THE DRAWINGS

FIG. 2 is a top view of the cannister with the wing in the fully deployed condition.

FIGS. 4A through 4C are top views of the submunition cannister showing the wing as it unfurls from the stowed to the fully deployed state.

DESCRIPTION OF THE PREFERRED EMBODIMENT

Figure 3:
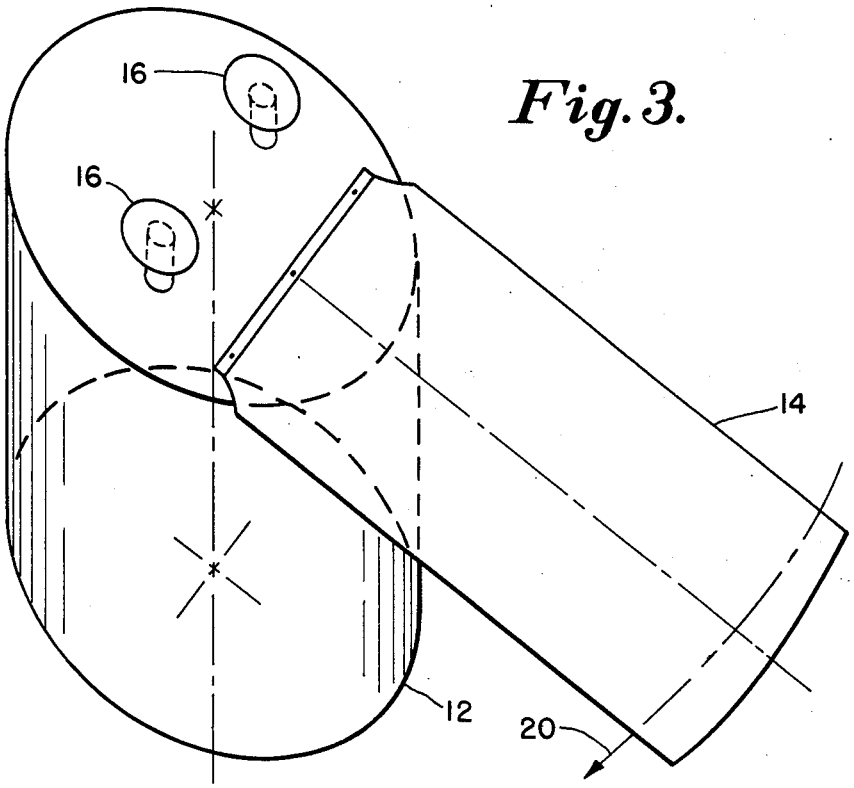
FIG. 3 is an isometric view of the submunition depicting its spinning motion as it descends toward the target.
Figure 1:
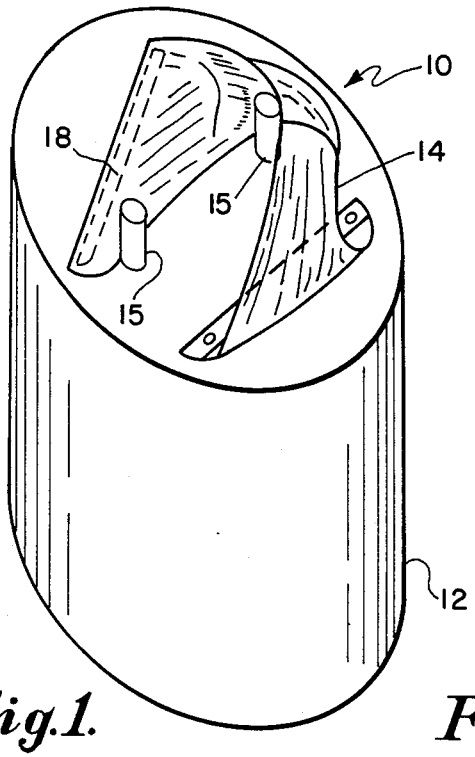
FIG. 1 is an isometric view of the submunition cannister depicting the wing in a stowed condition.

Referring to FIGS. 1–4, there is shown a submunition 10 comprising a warhead-bearing cannister 12 on the downstream end of which is a horizontal maneuvering wing 14. When the submunition is stowed within the shell casing (not shown) at launch, wing 14 is coiled as shown in FIGS. 1 and 4. To make 14 flexible enough to coil, it was found expedient to make the wing from a woven fibrous material, for example, aramid. It will be understood that the submunition is spinning as it is ejected from the shell casing. Once free of the shell casing, centrifugal force will cause the wing to move from the stowed position shown in FIG. 1 to the deployed position shown in Fig. 3. In the stowed condition shown in FIG. 1, wing 14 is wrapped around spin pins 15 which are positioned as shown on the end of cannister 12. The spin pins provide a controlled means whereby the wing 14 is kept in tension all the while it is deploying. The pins prevent twistup of the wing fabric during deployment. The two spin pins 15 are placed inboard of wing mount 22 (See FIG. 2). The wing is then wrapped around the pins in a direction which is opposite to the direction of rotation of the cannister. FIG. 1 shows spin pins 15 without any caps at the top. FIGS. 2–4 show capped spin pins 16 which prevent slippage of wing 14 material off the top end of the spin pins.

The centifugal force which acts to deploy the wing from the configuration shown in FIG. 4A to that shown in FIG. 2 relates to the spin rate of the submunition cannister and the magnitude of weight 18 in the wing tip. A typcial spin rate for the cannister (See arrow 20 in FIG. 2) is 30 revs/sec. Weight 18 for the FIG. 2 wing is typically 1.5 oz. for a submunition cannister weighing 9 lbs. The effective span of wing 14 is 7.5 inches and the wing chord is 4 inches. Calculating the centrifugal force which holds the wing in the deployed position shown in FIG. 2 makes use of the formula $$F = W/g\,(2\pi n)^2 l$$

where

W = weight at the tip of the wing g = 32.17 ft/sec$^2$ n = 30 rev/sec l = distance from center of rotation to wing tip Using the values implemented in the preferred embodiment, the centrifugal force maintaining the wing in an extended position calculates to a value of approximately 123 lbs. for a cannister 12 having a diameter of 4.5 in. This is adequate to hold wing 14 rather rigid as shown in FIGS. 2 and 3.

Choosing proper location for positioning the spin pins on the end of the submunition cannister depends on the chord and span dimensions of the wing as well as the attachment point of the wing to the cannister. For the chord to span ratio of the system reduced to practice, the inner end of wing 14 was attached midway between the edge and the center of cannister 12. Placement affects the amount of nutation of the cannister as it continues to spin while losing altitude. At least two spin pins are needed to properly stow the flexible wing. Experiment showed that the two spin pins 16 were properly positioned when placed as shown in FIG. 2, namely, placement is along a diameter 11 of cannister 12, with the diameter containing the spin pin axes being parallel to the line of attachment of wing 12 (See line 22). Spin pins 16 are symmetrically spaced with respect to the cannister axis 13 and the center-to-center spacing between the pins approximates the cannister radius.

Figure 5:
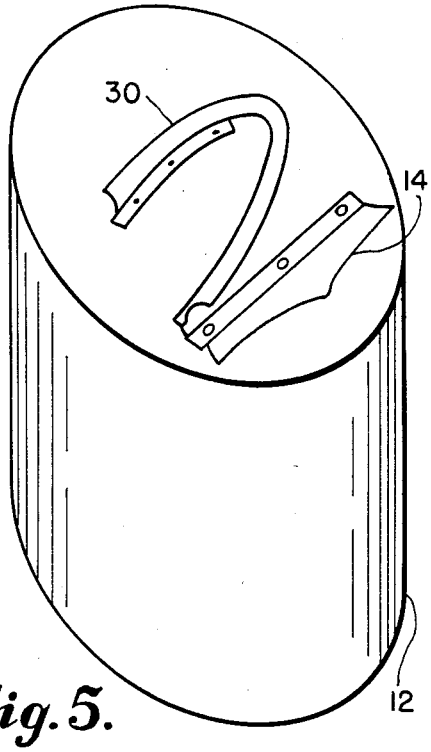
FIG. 5 shows an alternate implementation in which the wing is stowed against a continuous support.

The number of spin pins used can be increased to provide a smoother deployment of the wing. Taking this to the limit, the pins become a continuous curved surface, again with or without a cap to prevent the wing from slipping off (See FIG. 5). The shape of surface 30 or any surface approximated by a finite number of pins, can be tailored to provide a controlled acceleration of the wing to either reduce the acceleration loads or to prevent the wing from overspeeding and passing the desired steady state condition.

When the wing is deployed the submunition operates under the same laws of physics as a mapleseed that separates from a tree branch and spins downward and away from the parent tree. In the system reduced to practice a submunition was configured with a wing which allowed it to descend at a rather constant rate of 105 ft/sec. At the ame time the size of the deployed wing surface, the weight of the assembly and the inertial constants were chosen so that the characteristic frequency of rotation of the submunition was 30 revolutions per second. Due to the weight incorporated in the wing tip there is nutation of the axis of cannister 12 as the submunition spins downward. This expands the field of search of the built-in target sensor, providing an enlarged footprint. We found that the number of spin pins required is largely dependent on the length of the samara wing. A short wing may require only one or two spin pins. A long wing may require a support which is either a uniform arc or a multiplicity of spin pins which will give the appearance of an arcuate member. The spacing of the pins or the arcuate member can be a uniform distance from the center of rotation of the center of the submunition or it can be dispensed in an inwardly directed spiral. An inwardly directed spiral may be preferred in instances where a wing is long, since the maximum force appears on those spin pins farthest from the root connection between the wing and the submunition. The centrifugal force on a particular pin is also a function of the distance of the pin from the center of rotation. Thus, in situations where one anticipates extremely high centrifugal forces on some of the spin pins, it would be better to spiral the pins in towards the center.

Since the samara wing is stored on the downstream end of the submunition cannister there is a tendency for the deploying tip weight to move outward in a straight line tangential with the arc of rotation. Therefore, because the tip wants to move in a straight line while the submunition rotates, there is a tendency for the samara wing to attempt to twist about itself much like the twist seen in a propeller or in yarn. Also when the tip reaches the end of its travel where there is an enormous tension force applied to the bolts fastening the wing to the submunition. In practice this force must be taken into account as a design parameter.

While there has been shown and described what is at present considered to be the preferred embodiment of the invention, it will be obvious to those skilled in the art that various changes and modifications in the spin pins may be made without departing from the true scope of the invention as defined in the appended claims.

We claim:

1. Apparatus for stowing and deploying a flexible samara wing having a tip and a root end, the root end being joined by a wing mount to the downstream end of an air dispensed top attack submunition cannister rotating about an axis, said wing mount being along a line that is off axis but inboard the periphery of said cannister, said apparatus comprising at least one spin pin anchored in and extending outwardly from the downstream end of said cannister, pin placement enabling the tip end of said wing to be wrapped around said pin in a direction opposite to the direction of rotation of said cannister and thereby accomplish stowing of said wing within the periphery of the downstream end of said cannister.

2. Apparatus as defined in claim 1 wherein each spin pin includes an orthogonally disposed cap on its outermost end, said cap in combination with the side of said pin forming a channel for containing said samara wing when in the wrapped condition.

3. Apparatus as defined in claim 1 wherein two spin pins are anchored in the downstream end of said cannister, pin placement being along that cannister diameter which is parallel to the chord of said samara wing, said placement being spaced along said diameter so as to provide one pin on each side of the axis of rotation.

4. Apparatus as defined in claim 1 wherein a plurality of spin pins are used with placement being along an arc of a circle of a circle extending in a direction opposite to the direction of rotation of said cannister, the spin pin closest to the wing root connection being angularly displaced from said root connection.

5. Apparatus as defined in claim 4 wherein each of the plurality of said spin pins includes an orthogonally disposed cap on its outermost end thereby forming a retaining channel for more secure stowing of the samara wing.

* * * * *